US005243928A

United States Patent [19]

Brenaman

[11] Patent Number: 5,243,928

[45] Date of Patent: Sep. 14, 1993

[54] KAYAK DECK RACK ASSEMBLY

[76] Inventor: David E. Brenaman, HCR 78, Box 572, Naselle, Wash. 98638

[21] Appl. No.: 950,176

[22] Filed: Sep. 24, 1992

[51] Int. Cl.[5] ..... B63B 35/00

[52] U.S. Cl. ..... 114/347; 114/364; 224/273; 280/769

[58] Field of Search ..... 114/343, 364, 61, 85, 114/89, 90, 97, 98, 39.1, 39.2, 361, 347; D12/302, 317; 224/273, 42.11, 42.33, 42.43; 280/769

[56] References Cited

U.S. PATENT DOCUMENTS

| | | | |
|---|---|---|---|
| 4,345 | 12/1845 | Davis | 114/97 |
| 47,004 | 3/1865 | Fisher | 114/97 |
| 507,052 | 10/1893 | Voss | 114/97 |
| 4,739,720 | 4/1988 | Jarschke | 114/347 |
| 4,905,620 | 3/1990 | Newton | 114/39.1 |
| 5,056,448 | 10/1991 | Miller | 114/61 |

*Primary Examiner*—Joseph F. Peters, Jr.
*Assistant Examiner*—Clifford T. Bartz
*Attorney, Agent, or Firm*—Leon Gilden

[57] ABSTRACT

First and second cargo racks are mounted on opposed sides of the cockpit entry opening on a kayak deck to mount cargo relative to the kayak structure when limited cargo space is available within the kayak. The first and second racks include pairs of rail members mounted to supporting posts to fixedly secure the rails relative to the deck of the kayak member.

7 Claims, 4 Drawing Sheets

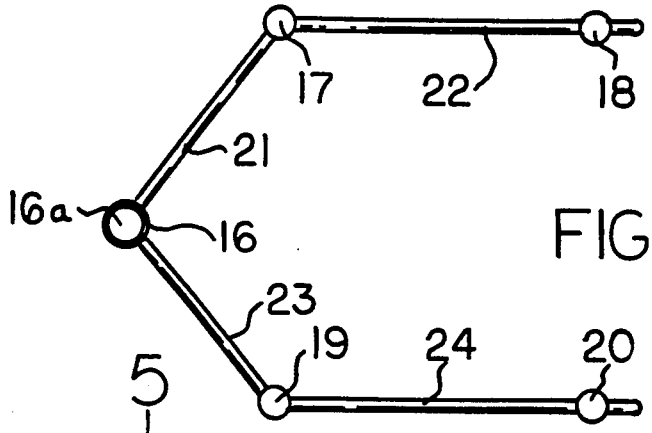
FIG 5
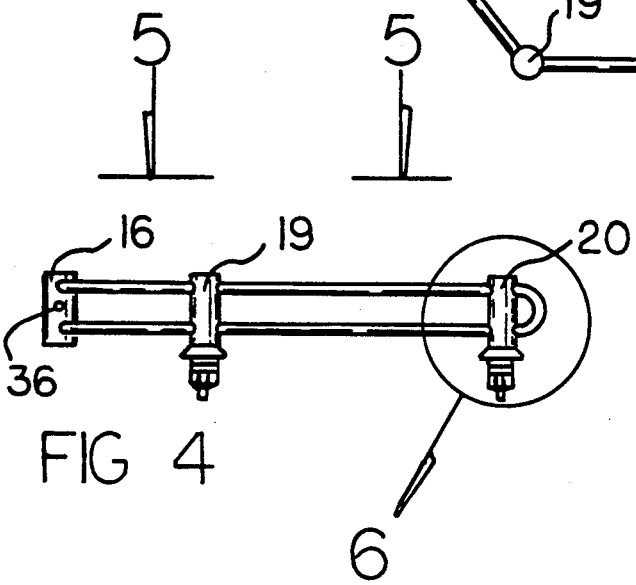
FIG 4
FIG 6
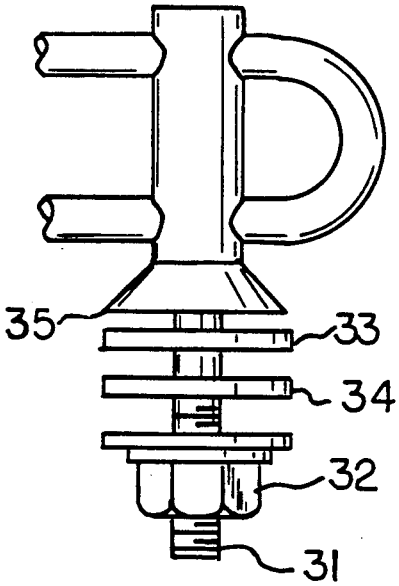
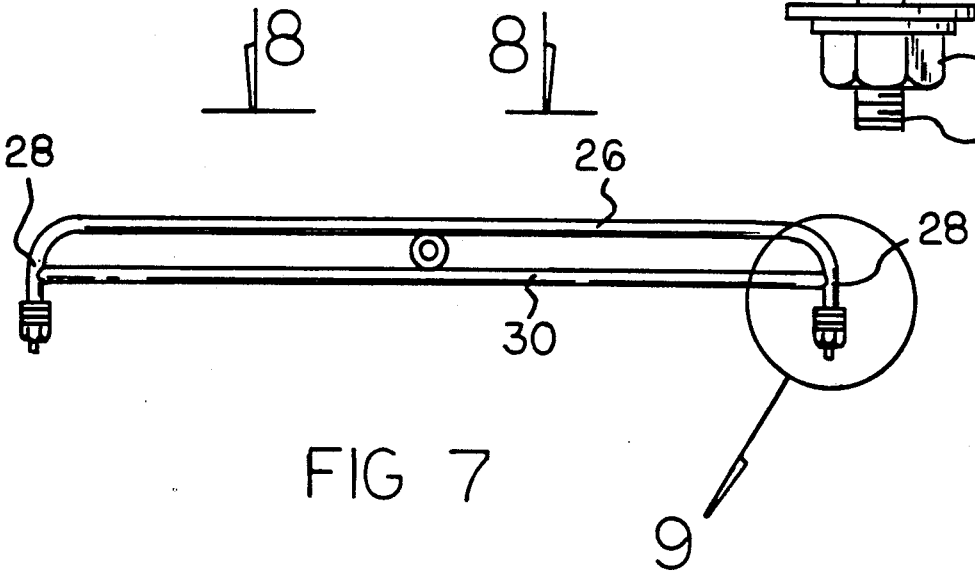
FIG 7

KAYAK DECK RACK ASSEMBLY

BACKGROUND OF THE INVENTION

1. Field of the Invention

The field of invention relates to cargo support structure, and more particularly pertains to a new and improved kayak deck rack assembly wherein the same is arranged for mounting of cargo relative to a kayak when limited cargo space is available.

2. Description of the Prior Art

Kayak structure as exemplified in the U.S. Pat. No. 4,821,666, with U.S. Pat. No. 4,739,720, indicating a pack assembly arranged for mounting to a kayak. U.S. Pat. Nos. 4,809,891 and 4,596,346 indicate the use of motorcycle and bicycle rack structure of tubular construction.

The instant invention attempts to overcome deficiencies of the prior art by providing for deck rack structure associated in particular with a kayak, wherein kayaks are availed of limited cargo space and in this respect, the present invention substantially fulfills this need.

SUMMARY OF THE INVENTION

In view of the foregoing disadvantages inherent in the known types of cargo rack structure now present in the prior art, the present invention provides a kayak deck rack assembly wherein the same utilizes tubular rack structure arranged for mounting to a deck portion of a kayak for supporting cargo relative to the kayak deck. As such, the general purpose of the present invention, which will be described subsequently in greater detail, is to provide a new and improved kayak deck rack assembly which has all the advantages of the prior art kayak storage apparatus and none of the disadvantages.

To attain this, the present invention provides first and second cargo racks mounted on opposed sides of the cockpit entry opening on a kayak deck to mount cargo relative to the kayak structure when limited cargo space is available within the kayak. The first and second racks include pairs of rail members mounted to supporting posts to fixedly secure the rails relative to the deck of the kayak member.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved kayak deck rack assembly which has all the advantages of the prior art kayak storage apparatus and none of the disadvantages.

It is another object of the present invention to provide a new and improved kayak deck rack assembly which may be easily and efficiently manufactured and marketed.

It is a further object of the present invention to provide a new and improved kayak deck rack assembly which is of a durable and reliable construction.

An even further object of the present invention is to provide a new and improved kayak deck rack assembly which is susceptible of a low cost of manufacture with regard to both materials and labor, and which accordingly is then susceptible of low prices of sale to the consuming public, thereby making such kayak deck rack assemblies economically available to the buying public.

Still yet another object of the present invention is to provide a new and improved kayak deck rack assembly which provides in the apparatuses and methods of the prior art some of the advantages thereof, while simultaneously overcoming some of the disadvantages normally associated therewith.

These together with other objects of the invention along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is an orthographic view, taken along the lines 4—4 of FIG. 2 in the direction indicated by the arrows.

FIG. 5 is an orthographic view, taken along the lines 5—5 of FIG. 4 in the direction indicated by the arrows.

FIG. 6 is an enlarged orthographic view of section 6 as set forth in FIG. 4.

FIG. 7 is an orthographic view, taken along the lines 7—7 of FIG. 3 in the direction indicated by the arrows.

DESCRIPTION OF THE PREFERRED EMBODIMENT

Figure 1:
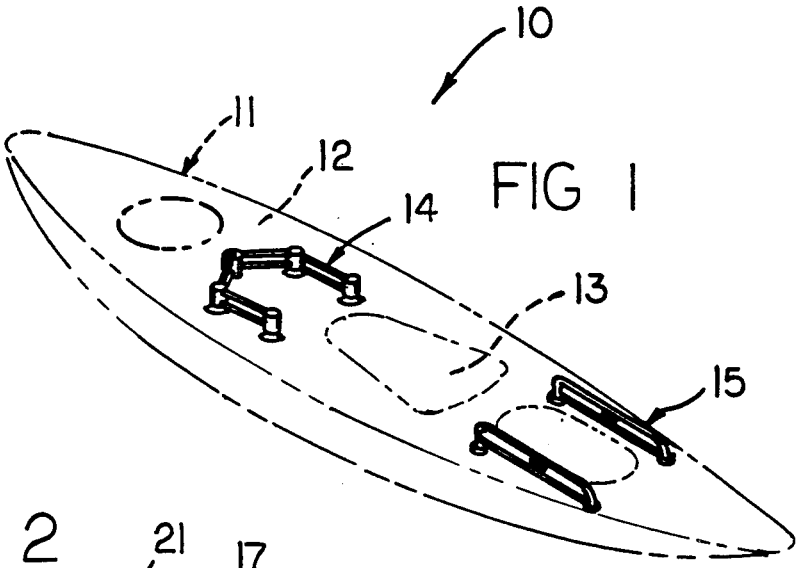
FIG. 1 is an isometric illustration of the instant invention.

With reference now to the drawings, and in particular to FIGS. 1 to 12 thereof, a new and improved kayak deck rack assembly embodying the principles and concepts of the present invention and generally designated by the reference numeral 10 will be described.

More specifically, the kayak deck rack assembly 10 of the instant invention essentially includes cooperation with a kayak member 11 having a kayak deck 12, with a cockpit opening 13 directed through the deck 12. A first cargo rack 14 is positioned on the deck 12 between the opening 13 and the bow portion or forward end of the kayak 11, with a second cargo rack 15 mounted to the deck 12 between the opening 13 and the stern or aft end portion of the kayak 11.

Figure 2:
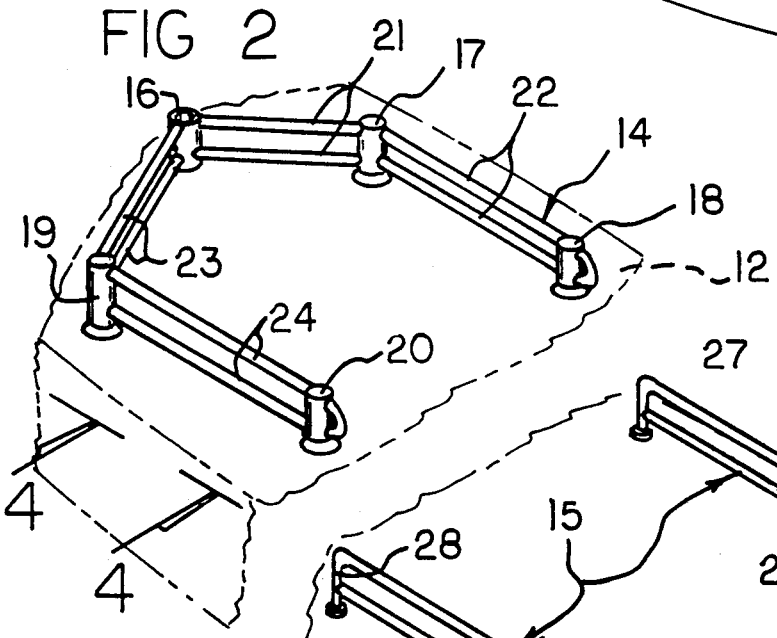
FIG. 2 is an enlarged isometric illustration of the first cargo rack.
Figure 3:
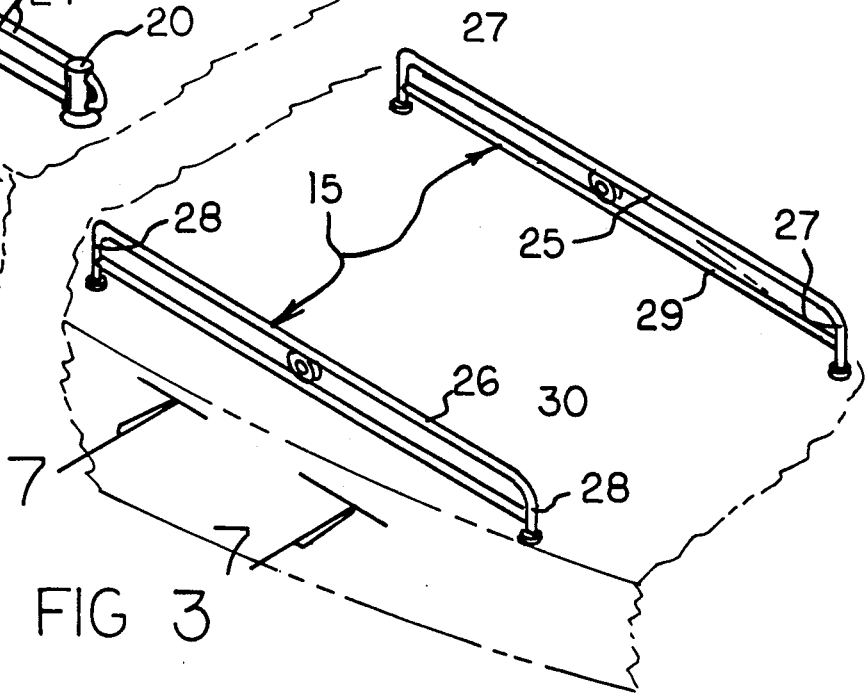
FIG. 3 is an enlarged isometric illustration of the second cargo rack.
Figure 8:
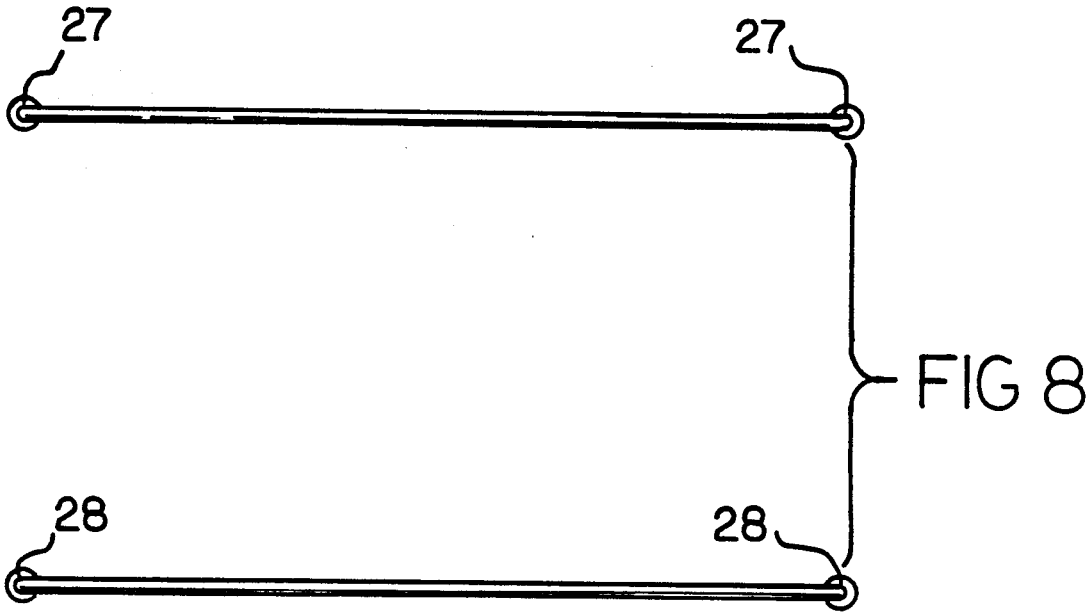
FIG. 8 is an orthographic view, taken along the lines 8—8 of FIG. 7 in the direction indicated by the arrows.
Figure 9:
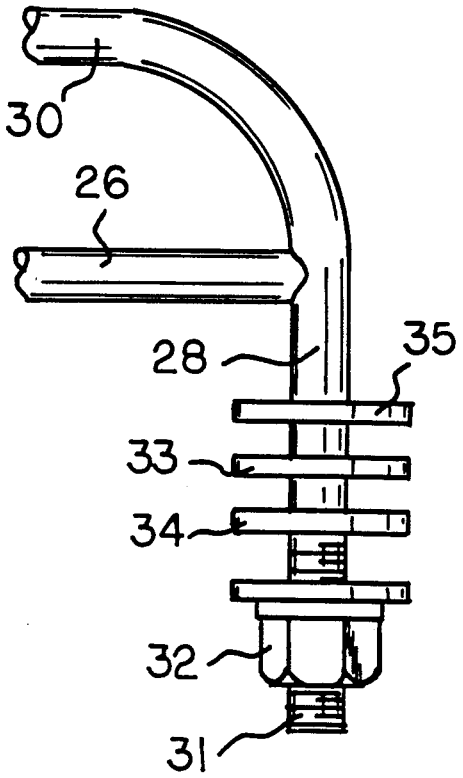
FIG. 9 is an enlarged orthographic view of section 9 as set forth in FIG. 7.

The first cargo rack 14 includes a central tubular post 16 orthogonally and fixedly mounted to the deck 12 cooperative with first and second mounting posts 17 and 18 oriented between the tubular post 16 and the opening 13, with a first parallel bar pair 21 mounted between the central post 16 and the first mounting post 17 and a second bar pair 22 mounted between the first mounting post 17 and the second mounting post 18. The first bar pair 21 are oriented at an obtuse angular orientation relative to the second bar pair 22. A third and fourth mounting post 19 and 20 are fixedly and orthogonally mounted to the deck 12, with a third bar pair 23 extending from the central post 16 to the third mounting post 19, and a fourth bar pair 24 extending between the third and fourth mounting posts 19 and 20. The second and fourth bar pairs are arranged in a parallel coextensive relationship, and the third and fourth bar pairs 23 and 24 are oriented at an obtuse angle therebetween, as indicated in FIG. 2.

The second cargo rack 15 includes respective first and second U-shaped bars 25 and 26 having respective first and second U-shaped bar anchor posts 27 and 28 at opposed distal ends of the respective first and second U-shaped bars 25 and 26. First and second connecting bars 29 and 30 extend respectively and orthogonally between the first and second U-shaped bar anchor posts 27 and 28. The mounting posts 17–20 and the anchor posts 27 and 28 each are mounted relative to the deck 12 employing (see FIGS. 6 and 9) an abutment plate 35 orthogonally oriented to a lower distal end of each post at an inner face of each post relative to an externally threaded extension rod 31. Confronting upper and lower resilient washers 33 and 34 receive the deck 12 therebetween, with the fastener 32 arranged to secure the deck 12 and the washers 33 and 34 between the abutment plate 35 and the fastener 32.

Figure 10:
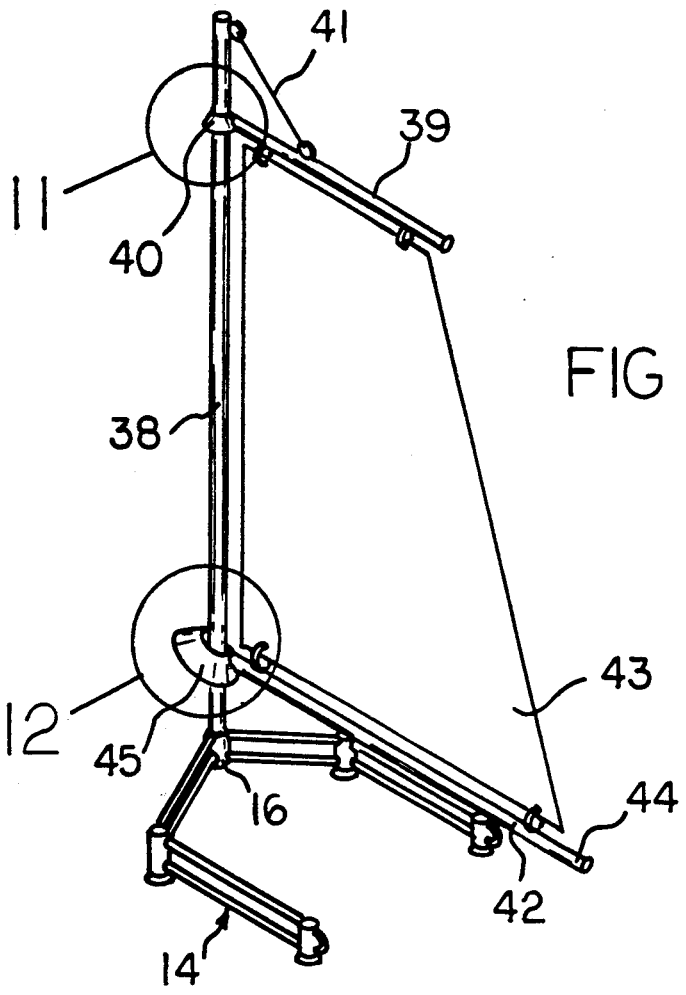
FIG. 10 is an isometric illustration of the invention employing a sail assembly.
Figure 11:
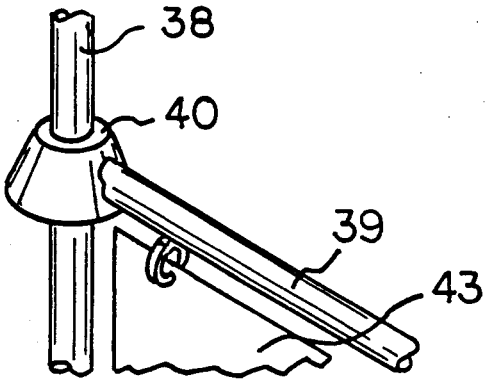
FIG. 11 is an enlarged isometric illustration of section 11 as set forth in FIG. 10.
Figure 12:
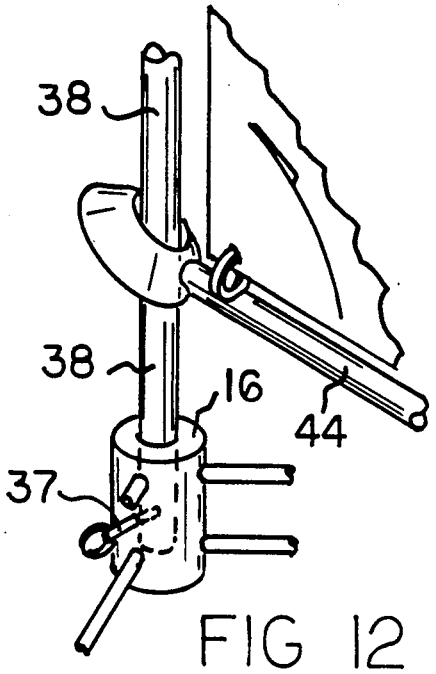
FIG. 12 is an enlarged isometric illustration of section 12 as set forth in FIG. 10.

The FIGS. 10–12 indicate the organization further employing a mast post 38 received within the central tubular post cylindrical socket **16*a*. A pin receiving bore 36 is orthogonally directed through the central tubular post 16 intersecting the cylindrical socket 16*a* to receive a lock pin 37 to direct the lock pin 37 through the mast post 38, as indicated in FIG. 12**.

The mast post 38 includes an upper boom 39, having an upper boom collar 40 rotatably mounted relative to the mast post 38. A support tether 41 includes its first end secured to the upper distal end of the mast post, with its second end secured to the upper boom 39. A lower boom 42 is provided spaced from and below the upper boom 39, with the lower boom 42 positioned above the central tubular post 16. The lower boom 42 includes a lower boom collar 45 whose axial bore is skewed relative to the lower boom to permit pivoting and folding of the lower boom in contiguous communication relative to the mast post for its storage thereof when the mast post is removed relative to the central tubular post 16. A flexible sail 43 is secured between the upper and lower booms 39 and 40, with the lower boom employing a lower boom extension 44 longitudinally aligned with the lower boom extending beyond the sail 43 for manual grasping by an individual positioned within the cockpit opening 13.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A kayak deck rack assembly for securement to a kayak deck having a cockpit opening therethrough, wherein the assembly comprises, a first cargo rack for securement to the kayak deck between the cockpit opening and a forward end of the kayak deck, and a second cargo rack for securement to the kayak deck oriented between the cockpit opening and the aft end of the kayak deck, the first cargo rack includes a central tubular post, a first mounting post and a second mounting post arranged parallel to and coextensive with the central tubular post, and a third mounting post and a fourth mounting post, and a pair of first parallel bars fixedly and orthogonally mounted between the central tubular post and the first mounting post, and a pair of second parallel bars mounted orthogonally and fixedly between the first mounting post and the second mounting post, and a pair of third parallel bars mounted between the central tubular post and the third mounting post, and a pair of fourth parallel bars mounted fixedly and orthogonally between the third mounting post and the fourth mounting post.

2. A deck rack assembly as set forth in claim 1 wherein the pair of third parallel bars and the pair of fourth parallel bars are arranged parallel to one another in a coextensive relationship, and wherein the pair of first parallel bars are oriented at an obtuse angle relative to the pair of second parallel bars, and the pair of third parallel bars are oriented at an obtuse included angle relative to the pair of fourth parallel bars.

3. A deck rack assembly as set forth in claim 2 wherein the second cargo rack includes a first U-shaped bar oriented parallel to and coextensive with a second U-shaped bar, the first U-shaped bar includes first U-shaped bar anchor posts at opposed ends of the first U-shaped bar, and the second U-shaped bar includes second anchor posts mounted at opposed ends of the second U-shaped bar, and a first connector bar fixedly and orthogonally mounted between the first anchor post, and a second anchor bar mounted fixedly and orthogonally between the second anchor post.

4. A deck rack assembly as set forth in claim 3 wherein the central tubular post includes a cylindrical socket, and a mast post received within the anchor socket, and the central tubular post having a pin receiving bore directed therethrough, and a lock pin, the lock pin directed through the pin receiving bore and to the mast post to secure the mast post within the pin receiving bore, and an upper boom rotatably mounted to the mast post, and a lower boom mounted to the mast post below the upper boom, and a flexible sail mounted between the upper boom and the lower boom.

5. A deck rack assembly as set forth in claim 4 wherein the upper boom includes a collar rotatably mounted about the mast post, and a support tether mounted between the upper boom and the mast post above the upper boom.

6. A deck rack assembly as set forth in claim 5 wherein the lower boom includes a lower boom collar, the lower boom collar having a bore directed therethrough, and the bore is oriented at a skewed orientation having an obtuse angle oriented between the lower boom collar and the lower boom permitting pivoting of the lower boom relative to the mast post.

7. A deck rack assembly as set forth in claim 6 wherein the lower boom includes a lower boom extension extending beyond the sail for manual grasping of the lower boom for manipulation of the sail.

* * * * *